United States Patent [19]

Brown et al.

[11] Patent Number: 4,995,792

[45] Date of Patent: Feb. 26, 1991

[54] COMPRESSOR SYSTEM WITH SELF CONTAINED LUBRICANT SUMP HEATER

[75] Inventors: Paul D. Brown; William J. Godecker; Charles B. Parme, all of San Diego, Calif.

[73] Assignee: Sundstrand Corporation, Rockford, Ill.

[21] Appl. No.: 399,261

[22] Filed: Aug. 28, 1989

[51] Int. Cl.[5] ..... F04B 39/02

[52] U.S. Cl. ..... 417/366; 418/55.6; 62/505

[58] Field of Search ..... 418/55.6, 63; 417/366; 62/468, 505

[56] References Cited

U.S. PATENT DOCUMENTS 3,106,334 10/1963 Fogleman et al. ..... 417/366
4,564,339 1/1986 Nakamura et al. ..... 417/366

FOREIGN PATENT DOCUMENTS 2553870 4/1985 France ..... 417/366
0069273 4/1985 Japan ..... 417/366

*Primary Examiner*—A. Michael Chambers
*Attorney, Agent, or Firm*—Wood, Phillips, Mason, Recktenwald & VanSanten

[57] ABSTRACT

Decreased lubricity of lubricating oil (36) in a compressor utilized in a vapor compression refrigeration system as well as decreases in thermal efficiency of such a system during start-up are avoided in a compressor structure including a housing (10) containing a compressing mechanism (28), (40) therein, an outlet (34) for the compression mechanism, an inlet (30), (32) for gas to compressed to the compressing mechanism (28), and a sump (24) within the housing (10) for containing the lubricant (36). A conduit (54), (60), (62), (64), (66) is utilized to direct compressed gas from the outlet (34) into heat exchange relation with the lubricant (36) within the sump (24) to drive any refrigerant in solution in the lubricant out of solution so as to improve lubricity and maintain system efficiency.

9 Claims, 2 Drawing Sheets

COMPRESSOR SYSTEM WITH SELF CONTAINED LUBRICANT SUMP HEATER

FIELD OF THE INVENTION.

This invention relates to compressors which include provision for lubrication of relatively moving parts by means of a lubricant contained in a sump, and more specifically, to a self contained means in the compressor system for heating the lubricant while in the sump.

BACKGROUND OF THE INVENTION

In various compressors systems, as, for example, compressors utilized in vapor compression refrigeration systems, oil is typically used for lubrication of moving parts within the compressor. Not untypically, the lubricating oil and the refrigerant that is to be compressed by the compressor have a relatively high affinity for each other in the sense that the refrigerant readily goes into solution within the oil. As these compressors include a sump into which the lubricating oil is drained, and such sump is commonly in fluid communication with the compressed refrigerant side of the compressor, the sump will contain a mixture of refrigerant and oil which may approach a one to one ratio.

As with the case of most solutions of gases within liquids, the colder the lubricant, the greater the solubility of the refrigerant therein. As a result, solubility of refrigerant in the lubricating oil will typically be the greatest when the system has been dormant for a while, that is, has not been operating such that the lubricant will have been warmed as it lubricates and cools relatively moving parts of the compressor.

In certain applications, such as aerospace applications, vapor compression refrigeration systems are utilized to cool electronic components. It is not unusual for such systems to be exposed to ambient temperature in the neighborhood of −40° F. with the consequence that if the system shuts down because of low demand for refrigeration, it will quickly cool and a great deal of refrigerant will be in solution within the lubricant when compressor operation is again called for.

This in turn causes two difficulties in the system. Firstly, because the lubricating oil is diluted by the large amount of refrigerant in solution, lubricity is lowered which in turn means increased wear rates for such time as the lubricity is low. Secondly, with the refrigerant in solution, it is not effectively in the vapor compression circuit which means that the efficiency of operation of the vapor compression circuit is decreased for so long as the refrigerant remains in solution. That is to say, there will be a lag in achieving full cooling capability in the operation of the vapor compression system until the refrigerant is driven out of solution in the lubricant.

The present invention is directed to overcoming one or more of the above problems.

SUMMARY OF THE INVENTION

It is the principal object of the invention to provide a new and improved compressor for the compression of gases. More specifically, it is an object of the invention to provide such a compressor that is ideally suited for use in vapor compression refrigeration systems and which will operate to minimize the time of operation of such a system with the lubricant at a low lubricity and with system efficiency decreased because of high solubility of refrigerant within the lubricant.

An exemplary embodiment of the invention achieves the foregoing object in a compressor including at least two relatively movable elements defining a variable volume chamber. Means are provided for relatively moving the elements to vary the volume of the chamber and thus to compress the gas contained therein. The compressor includes a sump for containing a lubricant to lubricate the parts of the compressor and means are provided for directing at least part of the gas compressed in the chamber in heat exchange relation with the sump to heat the lubricant therein with the heat of compression of the gas.

As a consequence of this construction, when the compressor is used in a vapor compression refrigeration system, the temperature of the lubricant is increased at a relatively rapid rate by the heat from the compressed gas which in turn reduces the solubility of refrigerant within the lubricant. Consequently, the refrigerant literally boils out of the lubricant and lubricity is rapidly improved and the full charge of refrigerant forced into operation within the system to bring system efficiency up to its maximum level.

More specifically, the invention contemplates a compressor that includes a housing. A compressing mechanism is disposed within the housing. An outlet for compressed gas is provided for the compressing mechanism and an inlet to the compressing mechanism is provided for gas to be compressed. A sump is located within the housing for containing the lubricant for the compressing mechanism and is in fluid communication with at least one of the compressing mechanism, the inlet and the outlet. Means are provided for heating the contents of the sump by exchanging heat from the compressed gas to the lubricant to decrease the solubility of the gas within the lubricant.

In a preferred embodiment of the invention, the means for heating includes a conduit in heat exchange relation with the sump and connected to the outlet to receive compressed gas therefrom.

A highly preferred embodiment of the invention contemplates that at least part of the housing including the sump be a cast housing and that the conduit be cast in the housing adjacent to sump.

According to another aspect of highly preferred embodiment of the invention, the compressing mechanism is a positive displacement rotary machine and there is included an electric drive motor coupled thereto. The housing is a pressure vessel for containing the rotary machine and the electric motor.

According to this embodiment, the sump may be at one end of the housing and the electrical drive motor at the opposite end of the housing with the rotary machine being located between the sump and the electric drive motor. The outlet is in the housing on the sump side of the motor and the means for heating includes a conduit in the housing in heat exchange relation with the sump and in fluid communication with the interior of the housing on the side of the electric drive motor opposite the outlet.

As a consequence of this specific construction, the heat exchanged to the sump will not only be the heat of compression of the gas, but additionally, heat imparted to the compressed gas as a result of cooling of the electrical drive motor as the compressed gas flows through the electric drive motor from the outlet to the conduit.

In a highly preferred embodiment, the full stream of compressed gas is directed in heat exchange relation to the sump and according to this embodiment, the housing, the outlet and the conduit are constructed and arranged so that substantially all of the gas leaving the outlet enters the conduit.

The invention also contemplates that the compressor be placed in a vapor compression cooling system and include a chlorofluorocarbon refrigerant within the compressor housing.

According to another aspect of the invention, the housing is generally cylindrical and in the form of a two-piece casting. The conduit is a curved conduit cast in one end of the housing and a further conduit is cast in the housing and includes aligned sections in the casting pieces extending from one end to the other of the housing and in fluid communication with the interior of the housing at the other end of the housing and generally centrally thereof.

Other objects and advantages will become apparent from the following specification taken in connection with the accompanying drawings.

DESCRIPTION OF THE PREFERRED EMBODIMENTS

Figure 1:
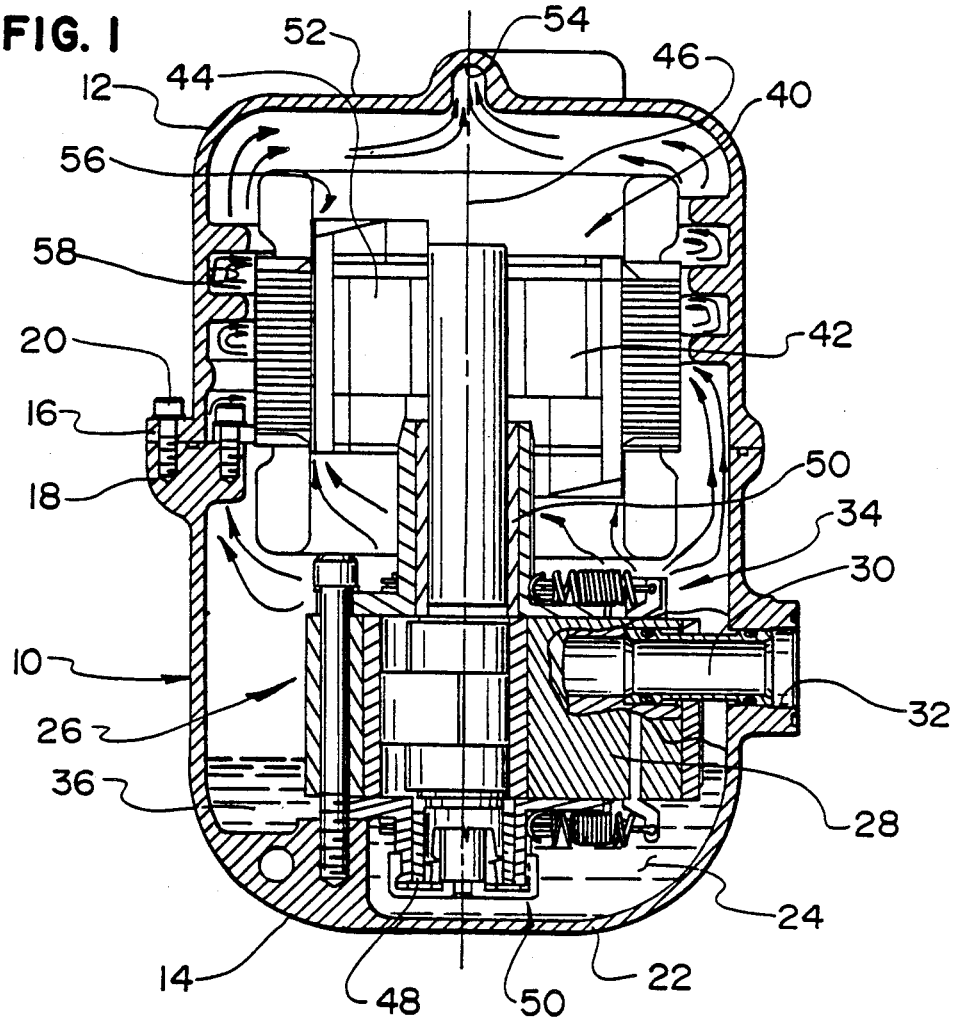
FIG. 1 is a sectional view of a compressor made according to the invention.

An exemplary embodiment of a compressor made according to the invention is illustrated in the drawings and with reference thereto is seen to include a housing, generally designated 10. The housing 10 is made up of upper and lower casting sections 12 and 14 respectively. As can be appreciated from the drawings, the housing sections are generally cylindrical and respectively include peripheral flanges 16 and 18 adjacent their respective open ends whereby the two may be abutted together to received threaded fasteners 20 to secure the same in assembled relation. An O-ring or similar seal (not shown) may be interposed between the flanges 16 and 18 to seal the interface of the two with the consequence that the housing 10 may then serve as a pressure vessel.

The lower end 22 of the section 14, on the interior thereof, serves as a sump 24 for lubricant which is intended to lubricate the compressing mechanism of the compressor. The compressing mechanism is generally designated 26 and is seen made up of a positive displacement, rotary compressor 28 of conventional construction. Typically, the compressing mechanism 28 will be a rotary compressor such as sliding vane/rolling piston mechanism. An inlet 30 is in fluid communication with a port 32 on the housing section 14 and, in a conventional fashion, establishes fluid communication between a source of a gas to be compressed in the compressing mechanism 28. Typically, the port 30 will be connected to the evaporator of a vapor compression refrigeration system.

The compressing mechanism 28 contains an outlet for compressed gas, generally indicated at 34. That is to say, the compressing mechanism 28 discharges compressed gas directly into the interior of the housing 10. As a consequence, compressed gas will exist above the level of lubricant 36 within the sump 24 and thus can go into solution within such lubricant.

Disposed principally within the upper housing section 12 is an electric motor of any desired type. The motor is generally designated 40 and includes a stator 42 mounted to the interior of the housing section 12, a rotor 44 and an output shaft 46 coupled to the compressing mechanism 28.

The system includes sleeve bearings such as shown at 48 and 50 for journaling the rotary components. Typically, a pumping mechanism of conventional construction is located in the area designated 51 and is operative to direct lubricant from the sump 24 upwardly through the bearing 48 and the bearing 50 during operation of the machine.

Figure 2:
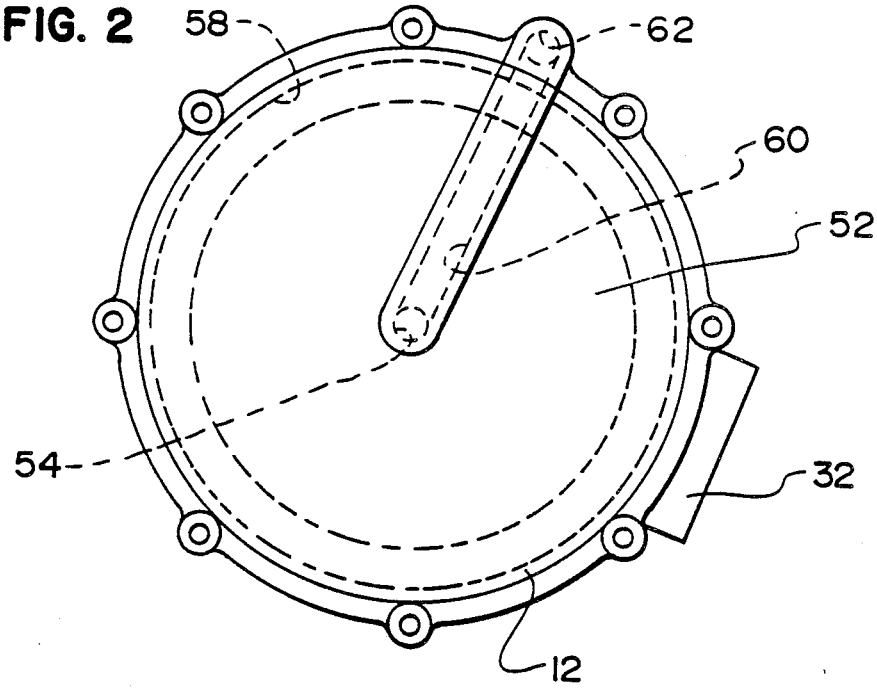
FIG. 2 is a plan view of the compressor.

It will be observed that the outlet 34 is on the sump side of the motor 40. Compressed gas that is to be returned to the system in which the system is used is taken out of the upper end of the housing 10, that is, the end 52 associated with the housing section 12 at a port 54 generally centrally thereof (FIG. 2). This means that the compressed gas from the outlet 34 will flow through the motor 40 before reaching the port 54. For flow paths for the gas are two-fold. A first path is through the air gap 56 surrounding the rotor and separating the rotor 44 from the stator 42. The other is via a series of helical or spiral passages 58 that are formed on the interior of the housing section 12. These passages 58 assure that the compressed gas is brought into good heat exchange relationship with the iron portions of the stator 42 for cooling the same.

Figure 3:
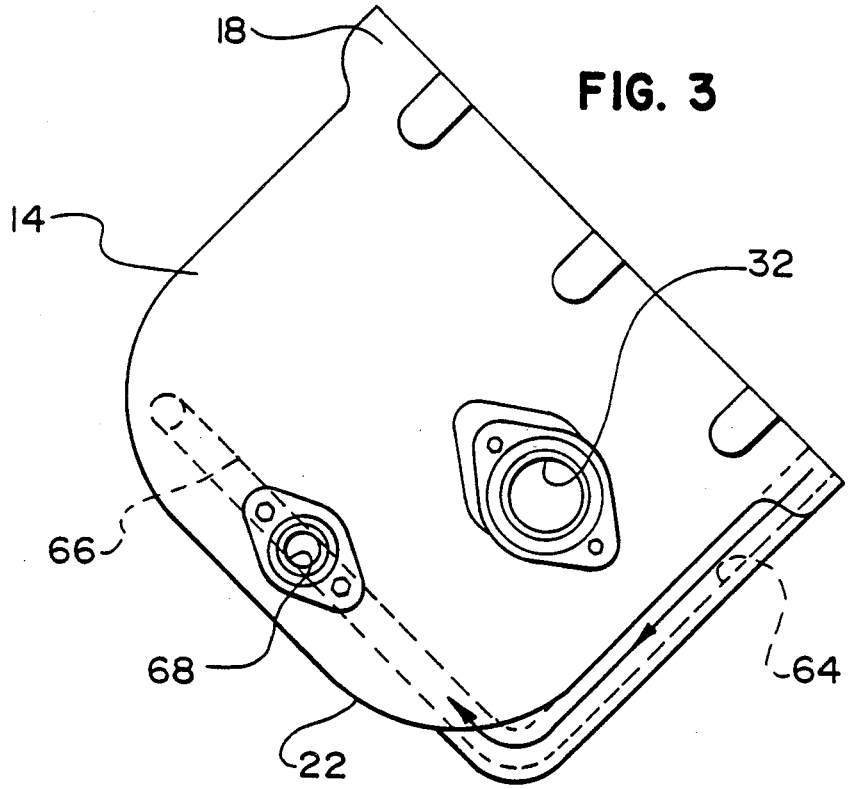
FIG. 3 is a side elevation of part of the compressor housing.
Figure 4:
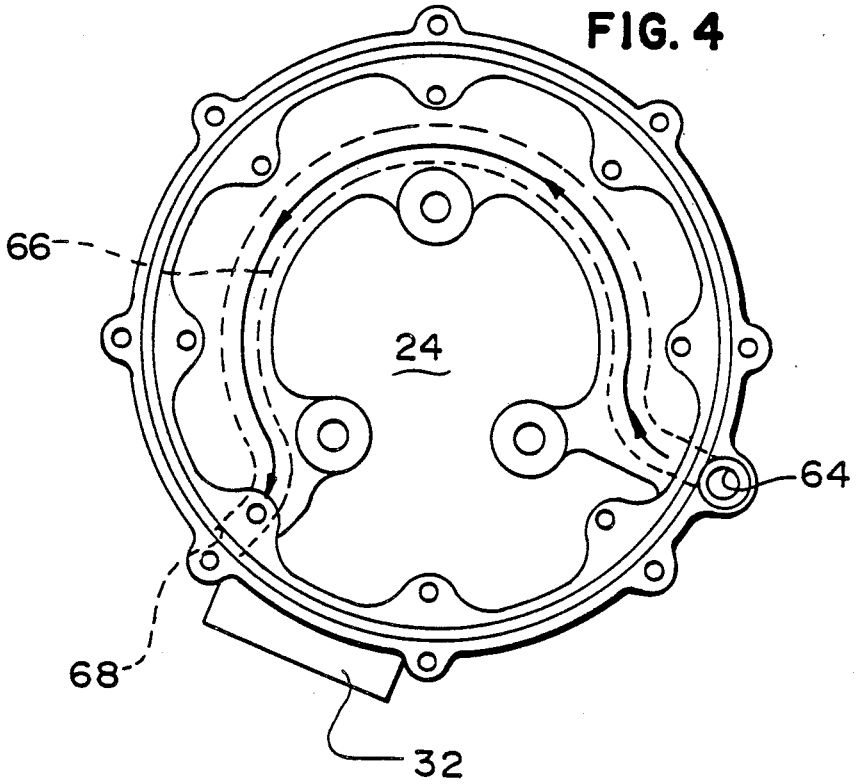
FIG. 4 is a plan view of the compressor housing section shown in FIG. 3.

As seen in FIG. 2, the port 54 is in fluid communication with a conduit 60 that extends along the end 52 of the housing section 12. When the periphery of the housing section 12 is reached, the conduit 60 merges with a conduit section 62 that runs along the side of the housing section 12. The conduit section 62 in turn is aligned with a conduit section 64 (FIGS. 3 and 4) in the housing conduit 14 which continues down the side the latter (FIGURE 3) to the end 22. At this location, the conduit 64 merges into an accurate conduit 66 within the housing section 14 and closely adjacent the end 22. As seen in FIG. 4, the section 66 is in surrounding relationship to the sump 24, extending about an arc length of 270°. It will also be seen that the conduit 66 is in close proximity or adjacency to the sump 24 and thus is in heat exchange relationship with the same. Finally, the conduit 66 terminates in a port 68 (FIGS. 3 and 4) which may be connected to, for example, a condenser in a vapor compression refrigeration system.

As a consequence of this construction, when the compressor is idle, substantial quantities of refrigerant, usually of the chlorofluorocarbon type such as R-12 or R-114 will be in solution within the lubricant 34. This in turn means that the lubricity of the lubricant 36 will be low while the effective amount of refrigerant within the system by which to accomplish cooling will be diminished. Upon start-up of the compressor, heat is added to the refrigerant by the action of the compressor. This is the so called heat of compression. Consequently, The temperature of the compressed gas will be elevated. In addition, as the gas passes from the outlet 34 to the port 54, it will be heated by heat resulting from losses occurring in the motor 40. This gas, now of elevated temperature, will be flowed via the conduit sections, 60, 62, 64 to the conduit 66 which acts as a heat exchanger with the sump 24. As a consequence of this, the lubricant 36 in the sump 24 will rapidly have its temperature increased. As the temperature of the lubricant 36 increases, the solubility of the refrigerant therein decreases rapidly. This in turn means that the lubricity of the lubricant 36 will be rapidly increased while the thermal efficiency of the system in which the compressor is used will also be rapidly increased as the full measure of the refrigerant is placed into circulation with the system.

The invention is particularly advantageous in that it does not require the use of any special means such as a separate heater or controls therefore to achieve the increase in lubricity and system efficiency upon start-up. However, the system is susceptible to temperature control, if desired, as such could be obtained by utilizing a thermostatic valve to control the quantity of compressed gas that is ultimately passed to the conduit 66.

In this respect while the described embodiment of the invention illustrates that the entire output of the compressor section 28 is passed in heat exchange relation with the sump 24, it should be readily recognized part or all of a stream could be diverted either in a controlled or uncontrolled fashion as desired.

Finally, while the invention has been described in connection with the compressor utilized for the compression of refrigerant in a vapor compression refrigeration system, those skilled in the art should readily appreciate that the same may be utilized wherever it is desirable to rapidly heat the lubricant for the moving parts of a compressor system upon start-up, whether or not solution of the gas to be compressed within the lubricant is a problem to be addressed.

We claim:

1. A compressor comprising:

a housing;

a compressing mechanism within said housing;

an outlet for compressed gas from said compressing mechanism;

an inlet for gas to be compressed to said compressing mechanism;

a sump within said housing for containing a lubricant for said compressing mechanism and in fluid communication with at least one of said compressing mechanism, said inlet and said outlet; and means for heating the contents of said sump by exchanging heat from said compressed gas to said lubricant to decrease the solubility of the gas within the lubricant.

2. The compressor of claim 1 wherein said means for heating include a conduit in heat exchange relation with said sump and connected to said outlet to receive compressed gas therefrom.

3. The compressor of claim 2 wherein at least part of said housing including said sump is cast and said conduit is cast in said housing adjacent said sump.

4. The compressor of claim 1 wherein said compressing mechanism comprises a positive displacement rotary machine and an electric drive motor coupled thereto, said housing being a pressure vessel and containing said rotary machine and said electric drive motor.

5. The compressor of claim 4 wherein said sump is at one end of said housing and said electric drive motor is at the opposite end of said housing with said rotary machine being located between said sump and said electric drive motor; said outlet being in said housing on the sump side of said motor and said means for heating includes a conduit in said housing in heat exchange relation with said sump and in fluid communication with the interior of said housing on the side of said electric drive motor opposite said outlet, whereby the heat exchanged to said sump may be the heat of compression of the gas and heat from the cooling of said electric drive motor as compressed gas flows through said electric drive motor from said outlet to said conduit.

6. The compressor of claim 5 wherein said housing, said outlet and said conduit are constructed and arranged so that substantially all the gas leaving said outlet enters said conduit.

7. A vapor compression cooling system including the compressor of claim 6 and further including a chlorofluorocarbon refrigerant in said housing.

8. The compressor of claim 6 wherein said housing is a generally cylindrical, two-piece casting and said conduit is an accurate conduit cast in one end of said housing and a further conduit cast in said housing including aligned sections in said casting pieces extending from one end to the other of said housing and in fluid communication with the interior of said housing at the other end said housing and generally centrally thereof.

9. A compressor including:

at least two relatively movable elements defining a variable volume chamber;

means for relatively moving said elements to vary the volume of said chamber to compress a gas therein;

a sump for containing a lubricant to lubricate the parts of the compressor; and means for directing at least part of the gas compressed in said chamber in heat exchange relation with said sump to heat the lubricant therein with the heat of compression of the gas.

* * * * *